US007503116B2

(12) United States Patent
Machrowicz et al.

(10) Patent No.: US 7,503,116 B2
(45) Date of Patent: Mar. 17, 2009

(54) CONTINUOUS PROCESS FOR PRODUCING A SHAPED STEEL MEMBER

(75) Inventors: Tad Machrowicz, Ortonville, MI (US); Frank McNulty, Rochester Hills, MI (US); Jeff Bladow, West Bloomfield, MI (US)

(73) Assignee: Noble Advanced Technologies, Inc., Warren, MI (US)

( * ) Notice: Subject to any disclaimer, the term of this patent is extended or adjusted under 35 U.S.C. 154(b) by 736 days.

(21) Appl. No.: 11/037,867

(22) Filed: Jan. 18, 2005

(65) Prior Publication Data

US 2005/0252588 A1 Nov. 17, 2005

Related U.S. Application Data

(60) Provisional application No. 60/537,695, filed on Jan. 20, 2004.

(51) Int. Cl.
*B23P 11/00* (2006.01)

(52) U.S. Cl. ..... 29/897; 29/525.14; 72/366.2; 72/372; 72/379.2; 148/601; 148/602; 148/661

(58) Field of Classification Search ..... 29/897.1, 29/897.2, 897.312, 897.32, 417, 525.14, 29/897; 72/366.2, 379.2, 372, 177, 178; 148/232, 592, 601, 604, 605, 607, 654, 661
See application file for complete search history.

(56) References Cited

U.S. PATENT DOCUMENTS

| | | | | |
|---|---|---|---|---|
| 2,836,018 | A * | 5/1958 | Key | 451/58 |
| 4,768,280 | A | 9/1988 | Palmer et al. | 29/527.4 |
| 5,237,846 | A | 8/1993 | Brooks, Jr. | 72/177 |
| 5,254,181 | A * | 10/1993 | Yoshino et al. | 148/231 |
| 6,405,919 | B2 | 6/2002 | Frohne et al. | 228/173.7 |
| 6,438,819 | B1 | 8/2002 | McGlinchy et al. | 29/564.6 |
| 6,454,884 | B1 | 9/2002 | McNulty et al. | 148/520 |
| 6,488,791 | B1 * | 12/2002 | Powers, II | 148/647 |
| 6,540,276 | B2 | 4/2003 | Azuchi et al. | 293/102 |
| 6,684,505 | B2 | 2/2004 | Sundgren et al. | 29/897.2 |
| 6,726,258 | B1 | 4/2004 | Sundgren et al. | 293/102 |
| 7,137,201 | B2 * | 11/2006 | Brodt et al. | 29/897.2 |
| 2002/0138987 | A1 * | 10/2002 | Nees | 29/897.312 |
| 2004/0123462 | A1 * | 7/2004 | Preijert et al. | 029/897.2 |

* cited by examiner

*Primary Examiner*—Jermie E Cozart
(74) *Attorney, Agent, or Firm*—Gifford, Krass, Sprinkle, Anderson & Citkowski, P.C.

(57) ABSTRACT

A continuous process for producing a shaped metal member from a feedstock comprising a flat web of metal includes a roll-forming station for shaping the web, a cutting station for cutting the shaped web into individual members, and a processing station for altering a physical characteristic of the metal comprising the members. The processing may include heat treating and/or shaping. The process may also be operable to carry out further operations such as marking, inspection, sorting and the like. Also disclosed is an apparatus for carrying out the process.

23 Claims, 3 Drawing Sheets

CONTINUOUS PROCESS FOR PRODUCING A SHAPED STEEL MEMBER

RELATED APPLICATION

This application claims priority of U.S. Provisional Patent Application Ser. No. 60/537,695 filed Jan. 20, 2004, and entitled "Method and Apparatus for the Continuous Fabrication of Shaped, Hardened, Steel Articles" which is incorporated herein by reference.

FIELD OF THE INVENTION

This invention relates generally to methods and apparatus for fabricating metal articles. More specifically, the invention relates to a method and apparatus for the continuous fabrication of metal articles. Most specifically, the invention relates to a combined roll-forming and article handling process for the manufacture of metal articles.

BACKGROUND OF THE INVENTION

Roll-forming is used with advantage in the fabrication of a number of variously configured metal objects. In a roll-forming process, a sheet of metal, typically steel, is continuously fed through a series of roller dies which progressively bend, stretch and shape the sheet into a body having a preselected cross-sectional profile. Roll-forming steps can be readily incorporated into continuous fabrication processes, and such techniques are widely used for the fabrication of various automotive components. Roll-forming processes, with a few notable exceptions, generally cannot be used to shape the longitudinal dimension of articles, and this does limit the utility of roll-forming techniques to some degree.

Other metal forming processes such as bending, stamping, forging, hydroforming, die-forming, post-forming and the like can be utilized to shape metal articles. Also, processes such as heat treating, nitriding, quenching and tempering may be employed to control hardness or other properties of metal articles. As will be explained hereinbelow, the present invention combines roll-forming with other metal shaping and treating processes to provide an integrated, continuous system and process for producing shaped metal articles.

Automobiles and other motor vehicles generally include a number of protective members therein such as bumper beams and side intrusion beams. These members must be high strength, and are preferably light in weight and low in cost. Bumper and intrusion beams are, as a consequence, often fabricated from folded, sheet steel members having a cross-sectional profile which may be of a C shape or of a closed, boxlike or circular cross section. Ideally, such members are relatively light in weight, of high strength, and low in cost. As will be detailed hereinbelow, one aspect of the present invention provides a continuous manufacturing process and apparatus for producing particularly configured high strength steel items such as bumper beams and side intrusion bars for motor vehicles. The method and apparatus of the present invention rely upon a combination of roll-forming and other processing operations carried out on a continuous basis utilizing coiled sheet steel. Unlike many roll-forming processes, the process of the present invention can be used to fabricate relatively complex shapes. These and other details of the present invention will be apparent from the drawings, discussion and description which follow.

BRIEF DESCRIPTION OF THE INVENTION

Disclosed herein is a continuous process for producing a shaped, metal member. The process begins with a coiled, substantially flat web of metal. A roll-forming station including a plurality of roller dies operable in combination to progressively shape a web of metal passing therethrough is provided. The web of metal is fed into the roll-forming station so that the roller dies therein shape the web into a continuous, elongated body having a preselected cross-sectional profile. The continuous, elongated body is cut into a plurality of members, each member having the preselected cross-sectional profile. A processing station is provided, and the members are fed into the processing station wherein they are processed so as to alter a physical characteristic of the metal comprising the members. In a specific embodiment, the processing station is a heating station. In other embodiments, the step of feeding the members into the processing station comprises collecting a plurality of members, grouping the members into a group of at least two members, and feeding that group of members into the station collectively. The members may, in some instances, be grouped according to their lengths. Processing may comprise heating the members for a period of time, and at a temperature, sufficient to effect the metallurgical transition therein.

In further embodiments of the invention, the members may be shaped after they have been heated by the use of a forming process.

In particular embodiments, wherein the processing station is a heating station, the atmosphere in the heating station may be controlled, for example as to provide an inert atmosphere, a reducing atmosphere, a nitriding atmosphere or an oxidizing atmosphere.

In further embodiments of the invention, features such as openings, raised protrusions or the like may be formed into the web prior to the time it is shaped in the roll-forming station. In yet other embodiments, the web may be subjected to an edge conditioning step prior to roll forming. In specific embodiments, the method is utilized to provide shaped, hardened, steel articles.

Also disclosed herein is an apparatus for carrying out the method.

DETAILED DESCRIPTION OF THE INVENTION

The present invention, in its most general form, comprises an apparatus for carrying out the continuous production of shaped metal members. The parts are preferably produced, on a continuous basis, from coiled webs of metal feedstock. The apparatus includes a payout station which supports a coiled web of metal and feeds that web to the other stations of the system. Downstream of the payout station is a roll-forming station which includes a plurality of roll-forming dies therein. The roll-forming station is operable to receive the web on a continuous basis and to form the web into a continuous, elongated body having a preselected cross-sectional profile. The system includes a cutting station, which is downstream of the roll-forming station, which is operable to cut the continuous, elongated body into a plurality of members each having the preselected cross-sectional profile. A heating station or other such processing station is downstream of the cutting station, and it is operable to alter a physical characteristic of the steel comprising the article. For example, when the metal being formed is steel and the processing station is a heating station, it can function to heat the steel to a temperature sufficient to effect a metallurgical transition; as for example by heating it above its austenizing temperature. In the illustrated embodiment, a die-forming station is disposed downstream of the heating station, and it is operable to receive the heated members from the heating station and to carry out a forming operation thereupon. The forming operation can alter the shape of the article, or it may likewise operate to maintain an existing shape throughout quenching operations or the like. Since the metal is relatively hot, and in a fairly plastic state, such operations can be implemented very easily. The die-forming station is further operative to quench the heated, formed, members. This quenching may be accomplished in the die by the use of a cooling fluid such as a water-based fluid. The quenching locks in a particular metallurgical phase, such as a martensitic phase, which at least partially hardens the steel thereby providing a hardened steel part.

This general system of the present invention may be employed to fabricate a variety of parts, and the particular configuration of system will depend, to some degree, upon the parts being fabricated. For purposes of illustration, the method of the present invention will be described in detail, with regard to one specific apparatus and process for the fabrication of hardened steel bumper beams. It is to be understood that a system of this type may be used to fabricate other items such as door beams, frame members, seat backs and other structural components. Also, the system may be employed to fabricate items from other metals such as aluminum.

Figure 1:
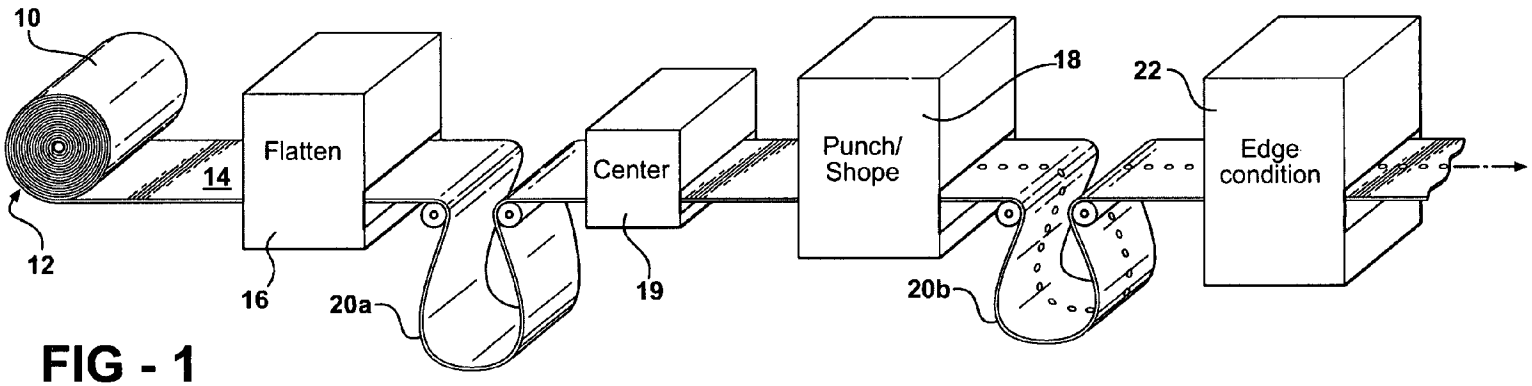
FIG. 1 is a schematic depiction of a portion of one embodiment of apparatus for carrying out the method of the present invention.

FIGS. 1-6 depict this particular system. Referring now to FIG. 1, there is shown a first portion of the system in which a coil of steel 10 is supported in a payout station which serves to feed a web of steel 14, on a continuous basis, to the remainder of the system. The steel may, in some instances, be coated so as to control corrosion during downstream processing, particularly during the heating and quenching steps. The coating may be organic or inorganic, and aluminum coated steel is one preferred material.

In the illustrated embodiment, the web of steel 14 passes to a flattening station 16 which serves to flatten the web 14, typically through the use of a set of rollers. The flattening station 16 may be dispensed with, depending upon the quality of the steel employed and/or downstream processing requirements. After exiting the flattening station 16, the web, in this embodiment, proceeds on to a punching and shaping station 18. Again, this station is optional; however, it functions to carry out one or more shaping operations on the web 14. These operations can include punching a number of openings in the web and/or forming embossed or coined features such as concave or convex features on the web. These openings and features can provide attachment points, screw holes, reinforcements, or pierce points which facilitate downstream cutting operations and the like. These features can also be used to "tune" the resiliency, crushability and/or other physical parameters of the finished product. By control of the geometry and placement of these features, finished parts having precisely shaped and positioned features and/or physical parameters may be produced in the process.

Markings may be applied to the material. These markings may comprise part numbers, logos, trademarks and the like. They may be applied by well-known techniques such as laser marking, ink jet printing, engraving or the like. The marking station may be associated with the punching and shaping station; or it may be otherwise disposed.

As will be seen from FIG. 1, a first 20*a* and second 20*b* slack loop are formed in the web. These loops accommodate the punching and shaping station which, in this embodiment, requires that the web be stationary during the time the punching and/or shaping operations are carried out. By use of the slack loops 20*a*, 20*b*, the web 14 may be continuously fed while allowing portions to stop for punching and shaping. The fact that portions of the web may halt during processing does not negate the fact that this is a continuous process. In other embodiments, the punching and shaping operations may be carried out on a moving web by the use of a roller die or similar apparatus.

Although not illustrated, the system may include dual payout stations wherein the end of one coil of steel may be welded or affixed to the beginning of another. This arrangement will allow for "on the run" replacement of coils, the slack loops will permit the system to run continuously during coil changes.

Downstream of the punching/shaping station 18 is an edge conditioning station 22. This station trims the edges of the web 14 to remove any irregularities therefrom. This station may be disposed upstream of the punching and shaping station 18, or it may be dispensed with completely, depending on the quality of the steel and the requirements of the process.

The system will preferably include one or more centering stations for keeping the center line of the web aligned with the center lines of the various stations. This centering is particularly important when punched or shaped features are included in the web, since it assures that the features will be properly placed in the finished article. The centering may be accomplished by mechanical members which engage the edges of the web. Centering may also be accomplished by systems having optical sensors, electronic sensors or other non-contact sensors. A centering station 19 may be associated with the punching/shaping station 18, as well as with the edge conditioning 22 and roll forming stations 24.

Figure 2:
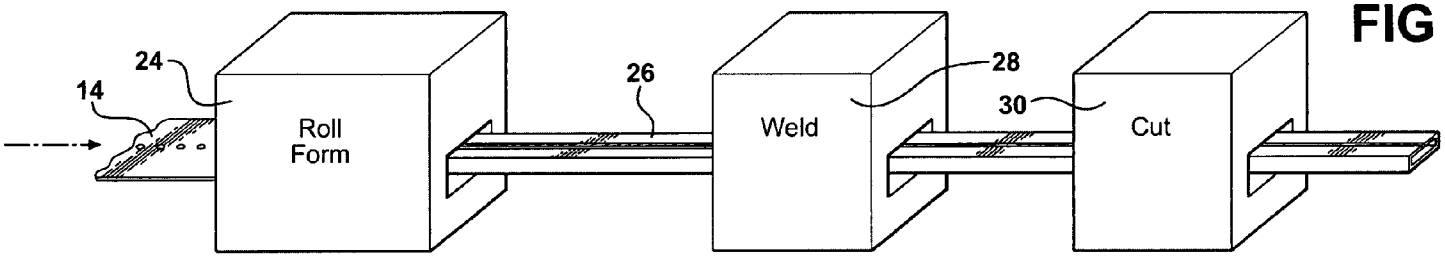
FIG. 2 is a schematic depiction of another portion of the apparatus.

Referring now to FIG. 2, there is shown another portion of the process, and as will be seen, the web 14, having features formed thereupon in the punching and shaping station, proceeds on to a roll-forming station 24. While this station 24 is shown in schematic form, it will be understood by one of skill in the art that it includes a plurality of roll-forming dies which progressively bend and shape the web 14 as it passes therethrough. As mentioned above, the roll-forming station will generally include a centering apparatus which is either associated with, or upstream of, the station for assuring that the web 14 is centered on the rollers as it passes therethrough. This is particularly important when preformed structural features of the web are incorporated into the final product.

As is shown in FIG. 2, the web 14 enters the roll-forming station and exits therefrom as a continuous, elongated body 26 having a preselected cross-sectional profile, which in this instance is a generally C-shaped profile. Downstream of the roll-forming station 24 is a joining station which functions to join the two free edges, or other portions of the continuous, shaped, elongated body 26 to one another or to other portions of the roll-formed body so as to form a closed cross-sectional profile. In this embodiment, joining is accomplished by a welding station 28, although it is to be understood that joining could be accomplished by soldering, adhesives, mechanical interlocking or the like. The welding station may be dispensed with in particular instances, or may be disposed in another portion of the apparatus. Welding may be accomplished by any number of techniques which are compatible with a continuously moving body. Some of the preferred techniques are induction welding, arc welding (including TIG and MIG welding), spot welding, gas welding, laser welding and resistance welding, among others.

In some instances, the system may include several welding and roll-forming stations, depending on the configuration of the profile being fabricated. For example, a first roll-forming station may shape a portion of the profile, and a first, mid-stream welding station will then join parts of the profile together, after which a second roll-forming station will further shape the profile; and following that, a second welding station will join the remaining parts of the profile. Clearly, yet other stations may likewise be included in the system. Following joining, the continuous, elongated shaped body 26 passes on to a cutting station 30 in which it is cut to preselected lengths so as to produce a number of members, each having the preselected profile of the elongated body 26. Cutting may be facilitated by preformed piercings formed in the web at the punching/shaping station 18 or by piercings formed in a separate upstream station (not shown). Cutting may be accomplished "on the fly" using available technology. The cutting station may be programmed to cut all of the members to the same length, or it may be operational to cut members to varying lengths, depending upon process requirements. In some instances, further operations, such as punching, stamping and the like, may be carried out on the workpiece either before, during or after the cutting by including further stations in the line. As noted above, in some embodiments of the invention, the members may be cut before being welded.

Figure 3:
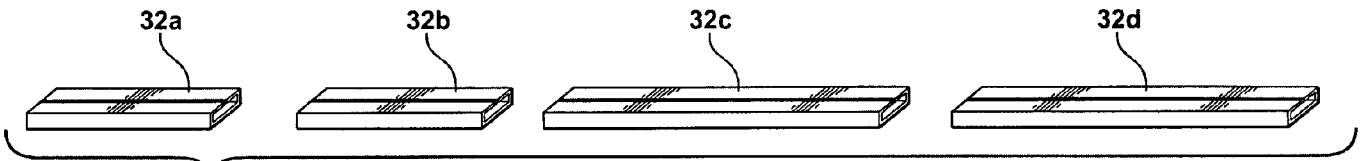
FIG. 3 is a schematic depiction of a number of roll-formed members which are passing through the apparatus of the present invention.
Figure 4:
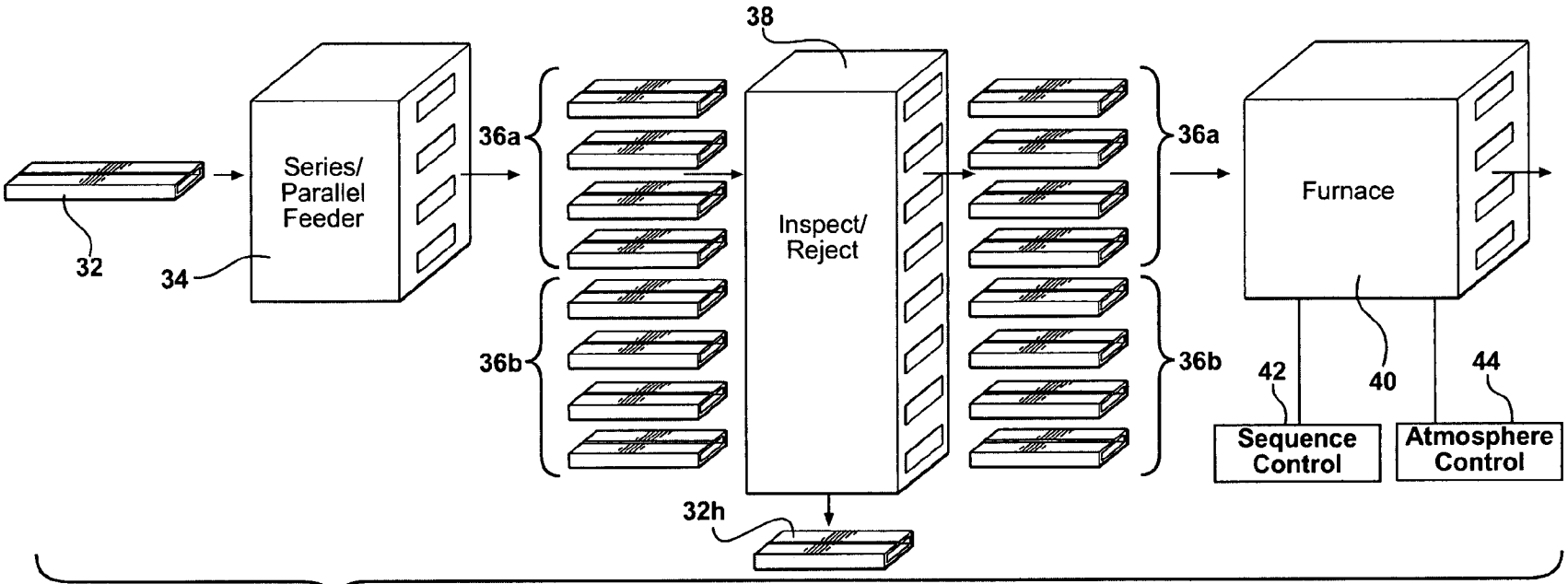
FIG. 4 is a schematic depiction of yet another portion of the apparatus.

Referring now to FIG. 3, there is shown a plurality of cut members 32*a*-32*d* passing along, in series, through the apparatus of the present invention. It should be noted that members 32*a* and 32*b* are shorter in length than members 32*c* and 32*d*. These members 32 pass, in series, to a series/parallel feeder station 34 which collects these serially disposed members, and groups them into a plurality of groups, each group having at least two of the members therein. As shown in FIG. 4, the series parallel feeder has grouped the members 32 into two separate groups 36*a*, 36*b*, each group 36*a*, 36*b* including four members. As is further shown in FIG. 4, the system includes an inspection/rejection station 38 which receives the groups 36*a*, 36*b* and inspects the members thereof to determine if they meet certain preselected criteria. Members not meeting these standards are rejected; and, as is shown in FIG. 4, member 32*a* has been rejected. The inspection station can also carry out a marking function wherein it operates to place identifying indicia on the parts. Such markings may indicate part numbers, tracking numbers, identity of the coil of steel from which the part was made, dates, customer numbers, quality control marks, and the like. The marking station may be in addition to any other marking station, or it may be the sole marking station. Marking may be accomplished by the use of high temperature ink, etching, mechanical means such as punching, scribing or engraving, or by use of a laser, electric arc or the like.

Following inspection, the groups of parts, for example group 36*a* and 36*b*, are sequentially fed into a metallurgical furnace 40. The furnace maintains the parts at an elevated temperature which is sufficient to bring about a metallurgical transformation in the metallic members loaded therein. In the particular process illustrated herein, this metallurgical transition is an austenizing transition, and in that regard, the parts are heated to a temperature in excess of 900° C. It is to be understood that the term "furnace" is used herein in its broadest sense to encompass all types of heating stations which can maintain the parts at an elevated temperature. As such, the furnace may include combustion heated furnaces, arc furnaces, resistance heated furnaces, as well as stations which heat parts by induction or radiant heating.

As illustrated, the furnace includes a sequence controller 42 which operates to regulate the residence time and ejection of parts from the furnace 40. As is further illustrated, the furnace 40 may also include an atmosphere controller 44 therein for providing a preselected atmosphere in the furnace. Typically, this atmosphere may be an inert gas atmosphere such as an argon atmosphere, a reducing atmosphere, or a nitriding atmosphere. In some operations, depending upon the nature of the metal being formed, it may be desirable to have an oxidizing atmosphere in the furnace, and such could also be accomplished by the atmosphere controller 44.

In some instances, the heating may be controlled in response to specific parts being fabricated. For example, the controller may operate in conjunction with the inspection station to identify parts which require specific temperature processing, and regulate the temperature at which the parts are then heat treated. In this manner, the system may operate, on a continuous basis, to heat different parts to different temperatures. Likewise, heating time may be controlled.

Figure 5:
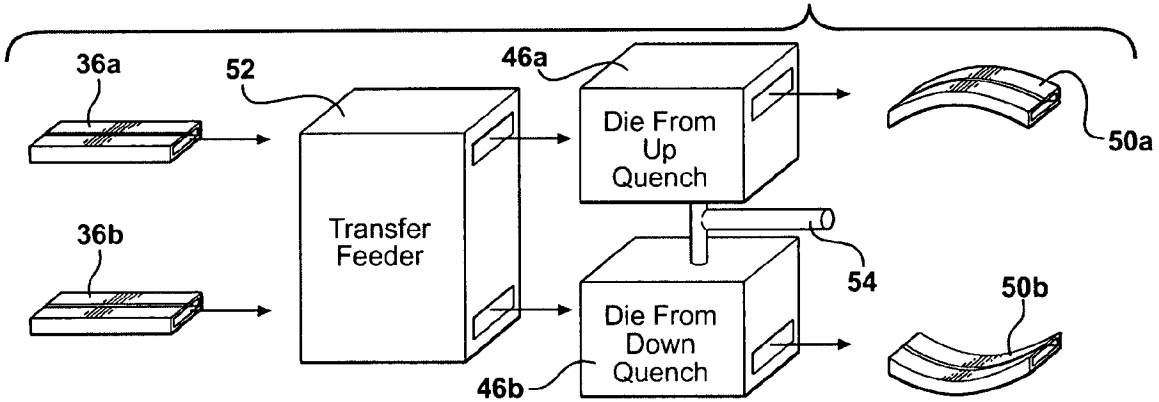
FIG. 5 is a depiction of the final portion of the apparatus showing roll and die-formed parts passing out of the apparatus.

Referring now to FIG. 5, and following the appropriate heat treatment in the furnace 40, heated parts, for example parts 36*a* and 36*b*, are ejected from the furnace, and while being maintained at an elevated temperature, are transferred to a pair of quenching dies 46*a*, 46*b*. Transfer is preferably accomplished by a robotic transfer feeder 52. These dies receive and shape the heated parts therein. The dies may shape the longitudinal profile of the parts as shown in the figures, or they may serve to hold and stabilize the roll-formed profile during quenching. Given the fact that the metal is heated, shaping is accomplished relatively easily and this fact is reflected in the design and construction of the dies. In some instances, the atmosphere between the furnace 40 and dies 46 may be controlled so as to prevent oxidation or other unwanted reactions of the heated parts. In yet other instances, welding operations may be carried out on the part while it is still at an elevated temperature. The welding may be carried out in the furnace, after the part exits the furnace, or in the die.

Following shaping, the parts are quenched within the die, typically by introducing a quench fluid into the dies through inlet 54. The quench fluid is typically a liquid, and generally a water-based liquid, although other quenching media may be employed as is known in the art. The quenching step hardens the metal and locks in the shape imposed thereupon by the die-forming step. As is shown in FIG. 5, finished, formed, hardened metal parts 50*a*, 50*b* are ejected from the forming dies 46*a*, 46*b*.

Figure 6:
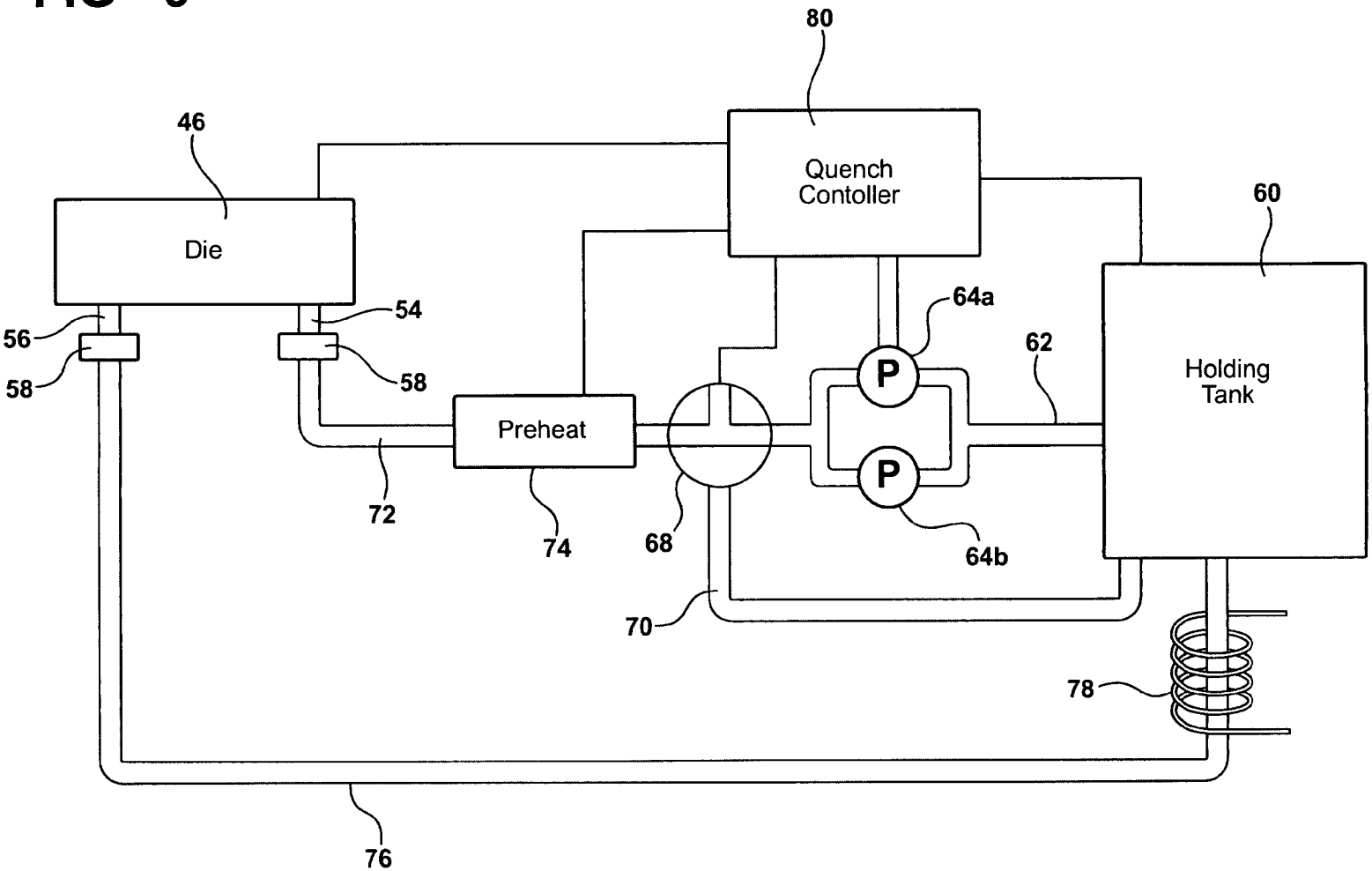
FIG. 6 is a schematic diagram of a quench fluid delivery system which may be used in the practice of the present invention.

Within the scope of the present invention, a number of different systems may be employed to deliver quench fluid to the dies. Referring now to FIG. 6, there is shown one particular system which may be employed in the present invention. As shown therein, quench fluid is introduced into a die 46 through a fluid inlet 54, and moved therefrom by an outlet 56. In this embodiment, the inlet 54 and outlet 56 are connected to the remainder of the quench fluid system by quick connect couplings 58, which facilitate removal and replacement of die units. The quench system of FIG. 6 includes a holding tank 60 which may include heaters or coolers (not shown) for maintaining the fluid at a preselected temperature. The quench fluid exits the holding tank by an outlet 62. In this embodiment, a pair of pumps 64*a*, 64*b* disposed in series operate to convey quench fluid from the holding tank 60 through the remainder of the system. While the pumping may be accomplished by a single pump, inclusion of a second pump provides for redundancy in the system which increases its reliability and allows for maintenance without requiring shutdown. In one mode of operation of this system most, and in some instances all, of the pumping function is carried out by a single pump at a given time, with the second pump being held in reserve. If one of the pumps fails, the second pump will come on line, thereby maintaining coolant flow while allowing the first pump to be repaired or replaced.

The system of FIG. 6 includes a diverter valve 68 downstream of the pumps 64*a*, 64*b*. The diverter valve 68 operates to selectively convey quench fluid to the die 46 or to a bypass return line 70. When the valve 68 is in a first position, the quench fluid passes from the pumps 64 to the die 46 by an inlet line 72, which in this embodiment includes a preheater 74 therein. The preheater functions to ensure that the quench fluid is at an appropriate temperature to effectively carry out quenching operations in the die 46. After the quench fluid has passed through the die 46 it exits via the die outlet 56 and returns back to the holding tank 60 via a return line 76. In the FIG. 6 embodiment, a heat exchanger 78 is associated with the return lines 76, and is operative to extract heat from the returning quench fluid prior to its entry into the holding tank 60. In other variations of the system, the heat exchanger 78 may be eliminated or disposed with the holding tank 60. Extracted waste heat from the heat exchanger 78 may be employed to heat other process fluids and/or provide ambient heating to the workplace.

When the diverter valve 68 is in a second position, quench fluid bypasses the die and returns directly to the holding tank via the diverter line 70. By using an arrangement of this type, the system can be operated so that the pump or pumps 64 operate continuously to maintain a flow of fluid. This keeps the pressure of the system constant and in balance and avoids starting and stopping the pumps which is detrimental to pump life and which can cause fluid hammering in the system which can damage the system or the die. In addition, this allows for quick on/off control of fluid flow thereby increasing the accuracy of the quenching process. Fluid flow can be further facilitated by tuning the inlet and outlet ports 54 and 56 respectively of the die to accommodate a smooth fluid flow.

Operation of the quench system is preferably under control of a microprocessor-based quench controller 80 which directly controls the operation of the pump 64*a*, 64*b*, valve 68 and preheater 74. The controller 80 will preferably obtain pressure and/or temperature data from various components of the system including the die 46, the preheater 74, the holding tank 60, pump 64*a*, 64*b* and valve 68 among other things. Other versions and modifications of the system of FIG. 6 may likewise be implemented in embodiments of the present invention.

The foregoing is illustrative of one particular embodiment of the present invention. It is to be understood that numerous modifications and variations thereof may be implemented. For example, the series/parallel feeder may be further operational to separate parts by length, and group the parts into length-based groups for charging into the furnace. Such groups may include parts which are of all one length as well as groups in which parts are of particular patterns of different lengths. In other embodiments, the furnace 40 may be programmed to provide different residence times for different parts charged thereinto, and in that regard may have plural feed and ejection systems which operate independently of one another. In yet other embodiments, the furnace may have a waste heat collector associated therewith. This collector could, for example, gather heated air from the immediate environment of the furnace and use that heat to warm process water or to supplement the heat for the workplace. Also, the die-forming and quenching station may include a plurality of different dies, and the system may be operational to charge specific parts into specific dies, depending upon the length and/or profile of the parts. In such embodiments, it will be desirable to standardize certain of the dimensions of the dies or other tooling so as to allow diverse tooling to be employed in the system at the same time. For example, if the forming dies are all of the same height and all have the same length of travel, adjustments to the press will not need to be made when dies are changed, also several different dies may be utilized at the same time.

Also, while the foregoing system has been described as incorporating a die-forming station and method, other embodiments may incorporate forming processes such as bending, stamping, forging, hydroforming, post-forming and the like. Also in yet other embodiments, the formed members may be otherwise treated in the processing station so as to alter a physical characteristic of the steel with or without further changing their shape. For example, the articles may be heat treated, nitrided, hardened or otherwise processed in the station. Still other modifications and variations will be apparent to those of skill in the art in view of the teaching herein.

In view of the foregoing, it is to be understood that the drawings, discussion and description presented herein are illustrative of specific embodiments of the present invention, but are not meant to be limitations upon the practice thereof. It is the following claims, including all equivalents, which define the scope of the invention.

The invention claimed is:

1. A continuous process for producing a shaped, steel member, said process comprising the steps of:

providing a coiled, substantially flat web of steel;

providing a roll-forming station, said roll-forming station including a plurality of roller dies operable in combination to progressively shape said web of steel passing therethrough;

feeding said web of steel into said roll-forming station so that the roller dies therein shape said web of steel into a continuous, elongated body of steel having a preselected cross-sectional profile;

cutting said continuous, elongated body of steel into a plurality of members, each member having said preselected cross-sectional profile;

providing a heating station;

feeding said members into said heating station;

heating said members in said heating station so as to alter a physical characteristic of said members;

shaping said members after they have been heated; and providing a controlled atmosphere around said members from the time said members are removed from the heating station until they are shaped.

2. The process of claim 1, wherein the step of feeding said members into said heating station comprises collecting a plurality of members, grouping said members into a group of at least two members, and feeding said group of members into said heating station collectively.

3. The process of claim 2, wherein said step of grouping said members comprises grouping said members according to their lengths.

4. The process of claim 2 further including a series to parallel feeder, wherein said series to parallel feeder receives said group of said members and places each of said members in said group in parallel with each other.

5. The process of claim 2 further comprising forming at least two of said groups, and sequentially feeding said at least two groups into the heating station.

6. The process of claim 1, wherein said step of heating said members, comprises heating said members for a period of time, and at a temperature sufficient to effect a metallurgical transition in the steel comprising said members.

7. The process of claim 6, wherein said metallurgical transition is an austenizing transition.

8. The process of claim 6, including the further step of quenching said members after they have been heated and after said metallurgical transition has been effected therein.

9. The process of claim 6, including the further step of controlling the atmosphere in said heating station during the time the step of heating said members in the heating station is being implemented.

10. The process of claim 9, wherein the step of controlling the atmosphere in the heating station comprises controlling the atmosphere so as to provide an atmosphere which is selected from the group consisting of: an inert atmosphere, a reducing atmosphere, a nitriding atmosphere, and an oxidizing atmosphere.

11. The process of claim 1, including the further step of forming at least one feature in said web prior to the step of feeding said web into said roll-forming station, said at least one feature comprising an opening defined in said web or a raised or indented feature which protrudes from the plane of said web.

12. The process of claim 1, including the further step of conditioning the edge of said web, said conditioning step being implemented prior to the step of feeding said web into said roll-forming station.

13. The process of claim 1, including the further step of joining portions of the web together after said web has passed through at least a portion of said roll-forming station so that the cross-sectional profile of the elongated body is an at least partially closed profile.

14. The process of claim 13, wherein said step of joining said portions is a welding process.

15. The process of claim 1, wherein said step of cutting said elongated body into plurality of members comprises cutting said elongated body into members having at least two different lengths.

16. A continuous process for producing a shaped, metal member, said process comprising the steps of:

providing a coiled, substantially flat web of metal;

providing a roll-forming station, said roll-forming station including a plurality of roller dies operable in combination to progressively shape said web of metal passing therethrough;

feeding said web of metal into said roll-forming station so that the roller dies therein shape said web of metal into a continuous, elongated body of metal having a preselected cross-sectional profile;

cutting said continuous, elongated body of metal into a plurality of members, each member having said preselected cross-sectional profile;

providing a heating station;

feeding said members into said heating station;

processing said members in said heating station so as to alter a physical characteristic of the metal comprising said members;

shaping said members after they have been heated; and providing a controlled atmosphere around said members from the time said members are removed from the heating station until they are shaped to a predetermined configuration.

17. The process of claim 16, wherein the step of feeding said members into said heating station comprises collecting a plurality of members, grouping said members into a group of at least two members, and feeding said group of members into said processing station collectively.

18. The process of claim 16, wherein said step of grouping said members comprises grouping said members according to their lengths.

19. The process of claim 17 further including a series to parallel feeder, wherein said series to parallel feeder receives said group of said members and places each of said members in said group in parallel with each other.

20. The process of claim 17, further comprising forming at least two of said groups, wherein each of said groups is sequentially fed into the heating station.

21. The process of claim 16 further including an inspection station, wherein each of said members is inspected to determine if each of said members meets a preselected criteria, and wherein any of said members not meeting said preselected criteria are removed from further processing.

22. The process of claim 21, wherein said inspection station includes a marking device for marking each of said members with identifying indicia.

23. A continuous process for producing a shaped, metal member, said process comprising the steps of:

providing a coiled, substantially flat web of metal;

providing a roll-forming station, said roll-forming station including a plurality of roller dies operable in combination to progressively shape said web of metal passing therethrough;

feeding said web of metal into said roll-forming station so that the roller dies therein shape said web of metal into a continuous, elongated body of metal having a preselected cross-sectional profile;

cutting said continuous, elongated body of metal into a plurality of members, each member having said preselected cross-sectional profile;

providing a heating station;

collecting a plurality of members, grouping said members into at least two groups, wherein each of said at least two groups has at least two members, and sequentially feeding each of said at least two groups into said heating station;

processing said members in said heating station so as to alter a physical characteristic of the metal comprising said members;

shaping said members after they have been heated; and providing a controlled atmosphere around said members from the time said members are removed from the heating station until they are shaped to a predetermined configuration.

* * * * *